US007220296B1

(12) United States Patent
Chowdhury et al.

(10) Patent No.: US 7,220,296 B1
(45) Date of Patent: May 22, 2007

(54) ELECTROLESS PLATING BATHS FOR HIGH ASPECT FEATURES

(75) Inventors: Shaestagir Chowdhury, Beaverton, OR (US); Matthew R. Bauer, Hillsboro, OR (US); Jeff Grunes, Aloha, OR (US); Soley Ozer, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/305,481

(22) Filed: Dec. 15, 2005

(51) Int. Cl.
*C23C 18/40* (2006.01)

(52) U.S. Cl. ..... 106/1.23; 106/1.26

(58) Field of Classification Search ..... 106/1.23, 106/1.26
See application file for complete search history.

(56) References Cited

U.S. PATENT DOCUMENTS

| | | | | |
|---|---|---|---|---|
| 6,645,567 | B2 * | 11/2003 | Chebiam et al. | 427/443.1 |
| 6,805,915 | B2 * | 10/2004 | Itabashi et al. | 427/437 |
| 2002/0011176 | A1 * | 1/2002 | Yoshida et al. | 106/1.23 |
| 2003/0143837 | A1 * | 7/2003 | Gandikota et al. | 438/629 |
| 2004/0038073 | A1 * | 2/2004 | Chebiam et al. | 428/668 |
| 2004/0152303 | A1 * | 8/2004 | Verbunt | 438/678 |
| 2005/0164499 | A1 * | 7/2005 | Marumo et al. | 438/678 |

OTHER PUBLICATIONS

Valery M. Dubin et al., "Method to Fabricate Copper-Cobalt Interconnects", U.S. Appl. No. 10/943,610, filed Sep. 17, 2004, 28 pages.

Jun Li and Paul A. Kohl.; The Acceleration of Nonformsldehyde Electroless Copper Plating [ Journal of the Electrochemical Society, 149, C631 (2002)]; Journal of The Electrochemical Society, 150 (3) L7 (2003).

Zenglin Wang et al.; Bottom-Up Fill for Submicrometer Copper Via Holes of ULSIs by Electroless Plating.; Jounal of The Electrochemical Society, 151 (12) C781-C785 (2004).

Jaeyoung Choi et al.; A Method for Selective Deposition of Copper Nanoparticles on Silicon Surfaces.; Jounal of The Electrochemical Society, 150 (8) C563-C565 (2003).

M.Ramasubramanian et al.; A Mathematical Model for Electroless Copper Deposition on Planar Substrates.; Jounal of The Electrochemical Society, 146 (1) 111-116 (1999).

Hong-Hui Hsu et al.; Displacement Activation of Tantalum Diffusion Barrier Layer for Electroless Copper Deposition.; Jounal of The Electrochemical Society, 148 (9) C590-C598 (2001).

(Continued)

*Primary Examiner*—Helene Klemanski
(74) *Attorney, Agent, or Firm*—Rahul D. Engineer

(57) ABSTRACT

An electroless plating bath for filling high aspect ratio features with copper metal comprises water, a water soluble copper containing compound having an initial concentration of 0.5 to 50 g/L, a catalyst reducing agent having an initial concentration of 0.02 to 1.5 g/L, a bulk reducing agent having an initial concentration of 2.37 to 29.7 g/L, a buffering agent having an initial concentration of 25 to 100 g/L, a grain refining additive having an initial concentration of 0.25 to 5.0 g/L, a bath stabilizing agent having an initial concentration of 0.02 to 0.1 g/L, and a rate controlling additive having an initial concentration of 0.01 to 0.5 g/L. The catalyst reducing agent may comprise glyoxylic acid and the bulk reducing agent may comprise glycolic acid or hypophosphite.

27 Claims, 2 Drawing Sheets

OTHER PUBLICATIONS

Jun Li and Paul A. Kohl.; The Deposition Characteristics of Accelerated Nonformaldehyde Electroless Copper Plating.; Jounal of The Electrochemical Society, 150 (8) C558-C562 (2003).
S.Z.Chu et al.; Copper Electroless Plating at Selected Areas on Aluminum with Pulsed Nd-YAG Laser.; Jounal of The Electrochemical Society, 147 (4) 1423-1434 (2000).
Young-Soon Kim et al.; Direct Copper Electroless Deposition on a Tungsten Barrier Layer for Ultralarge Scale Integration.; Jounal of The Electrochemical Society, 152 (2) C89-C95 (2005).
W.H.Yu et al.; Electroless Plating of Copper on (100)-Oriented Single Crystal Silicon Substrates Modified by Plasma Graft Polymerization of 4-Vinylpyridine.; Jounal of The Electrochemical Society, 149 (11) C592-C599 (2002).
W.H.Yu et al.; Electroless Plating of Copper via a Sn-Free Process on Dielectric SiLK Surface Modified by UV-Induced Graft Copolymerization with 4-Vinylpyridine and 1-Vinylimidazole.; Jounal of The Electrochemical Society, 149 (10) C521-C528 (2002).
Shen Ye et al.; Spectroscopic Studies on Electroless Deposition of Copper on a Hydrogen-Terminated Si(111) Surface in Fluoride Solutions.; Jounal of The Electrochemical Society, 148 (6) C421-C426 (2001).
Zhang Yi-Heng et al.; Electroless Copper Depostion in the Photographic Gelatin Layer.; Jounal of The Electrochemical Society, 146 (4) 1270-1272 (1999).
Chia-Cheng Yang et al.; Synthesis and Characterization of PVP Stabilized Ag/Pd Nanoparticles and Its Potential as an Activator for Electroless Copper Deposition.; Jounal of The Electrochemical Society, 152 (2) C96-C100 (2005).
Seok Woo Hong et al.; Palladium Activation on TaNx Barrier Films for Autocatalytic Electroless Copper Deposition.; Jounal of The Electrochemical Society, 149 (1) G85-G88 (2002).
Hong-Hui Hsu et al.; Electroless Copper Depsosition for Ultralarge-Scale Integration.; Jounal of The Electrochemical Society, 148 (1) C47-C53 (2001).
D.T.Hsu et al.; Compatibility of the Low-Dielectric-Constant Poly(arylether) with the Electroless Copper-Deposition Solution.; Jounal of The Electrochemical Society, 146 (12) 4565-4568 (2002).
Pei-Chi En.; Polymer Communications; Improved ABS Plastic Activating Treatment for Electroless Copper Plating.; Polymer vol. 36 No. 17, pp. 3399-3400, 1995.; Elsevier Science Ltd. Printed in Great Britain.
S.P.Chong et al.; Electroless Copper Seed Layer Deposition on Tantalum Nitride Barrier Film.; Science Direct, Surface & Coatings Technology, SCT-10907; (2004), pp. 1-4.
S.J. Choi et al., The Optimal Condition of Acidic Electroless Copper Plating Method for Ti, Zr-based Hydrogen Storage Alloys for Electrode Use. Journal of Alloys and Compounds 356-357 (2003) 720-724.
Hiroshi Yanagimoto et al.; Selective Electroless Copper Deposition on Aluminum Nitride Substrate with Patterned Copper Seed Layer.; Thin Solid Films TSF-19110; (2004), pp. 1-5.
Farid Hanna et al.; Controlling Factors Affecting the Sability and Rate of Electroless Copper Plating.; Materials Letters 58 (2003) 104-109.
J.C. Patterson et al.; Electroless Copper Metallisation of Titanium Nitride.; Applied Surface Science 91 (1995) 124-128.
V.W.L. Lim et al.; Electroless Plating of Palladium and Copper on Polypyrrole films.; Synthetic Metals 123 (2001) 107-115.
Yi-Mao Lin et al.; Effects of Additives and Chelating Agents on Electroless Copper Plating.; Applied Surface Science 178 (2001) 116-126.
Jun Li et al.; The Influence of 2,2'-Dipyridyl on Non-Formaldehyde Electroless Copper Plating.; Electrochimica Acta 49 (2004) 1789-1795.
Haruo Akahoshi et al.; Fine Line Circuit Manufacturing Technology with Electroless Copper Plating.; IEEE Transactions on Components. Packaging and Manufacturing Technology—Part A, vol. 18, No. 1, Mar. 1995.
J.H. Chang et al., Morphology and Adhesion Strenght in Electroless Cu Metallized A1N Substrate., IEEE Transactions on Components, Hybrids and Manufactuing Technology, vol. 16, No. 8, Dec. 1993.
D.H. Cheng et al., Electroless Copper Plating Using Hypophosphite as reducing Agent.; Elsevier Science Inc., Metal Finishing, Jan. 1997.
Masahiro Oita et al., Deposition Rate and Morphology of Electroless Copper Film from Solutions Containing 2,1'-Dipyridyl.; Electrochimica Acta. vol. 42, No. 9, pp. 1435-1440, 1997. Printed in Great Britain.
Michinari Sone et al., Electroless Copper Plating Using FeII as a Reducing Agent., Electrochimica Acta 49 (2004) 233-238.

* cited by examiner

ELECTROLESS PLATING BATHS FOR HIGH ASPECT FEATURES

In the manufacture of integrated circuits, copper interconnects are generally formed on a semiconductor substrate using a copper damascene process (e.g., a dual damascene process which is well known in the art). In this process, a trench is etched into a dielectric layer and the trench is filled with a conventional barrier and seed layer. An electroplating process may then be used to fill the trench with copper metal to form the interconnect.

As device dimensions scale down, the aspect ratio of features such as trenches and vias becomes more aggressive as the feature becomes more narrow. Conventional processes for depositing copper into these features include PVD, chemical vapor deposition (CVD), atomic layer deposition (ALD), and electroplating. Unfortunately, the aggressive aspect ratios give rise to issues such as trench overhang, thereby resulting in pinched off the trench openings that cause voids to appear within the copper interconnect. Such voids may greatly increase the resistivity of the interconnect line.

Electroless deposition processes have been used to address issues with high aspect ratio features. Other issues, however, tend to arise such as unstable copper baths with narrow temperature windows and narrow pH windows and copper metal corrosion or pitting due to the long nucleation times needed to fill the high aspect ratio features. Furthermore, important secondary issues need to be considered such as high monetary costs and potential health hazards associated with the plating bath components. For instance, glyoxylic add, which is an important component of conventional plating baths, is a very expensive chemical. Alternates to glyoxylic acid tend to be expensive, carcinogenic, or both. Accordingly, an improved electroless copper deposition chemistry is needed to address the drawbacks present when electrolessly plating copper into high aspect ratio features, for instance, features having a width of between 5 nm and 20 nm and an aspect ratio greater than five.

DETAILED DESCRIPTION

Figure 1:
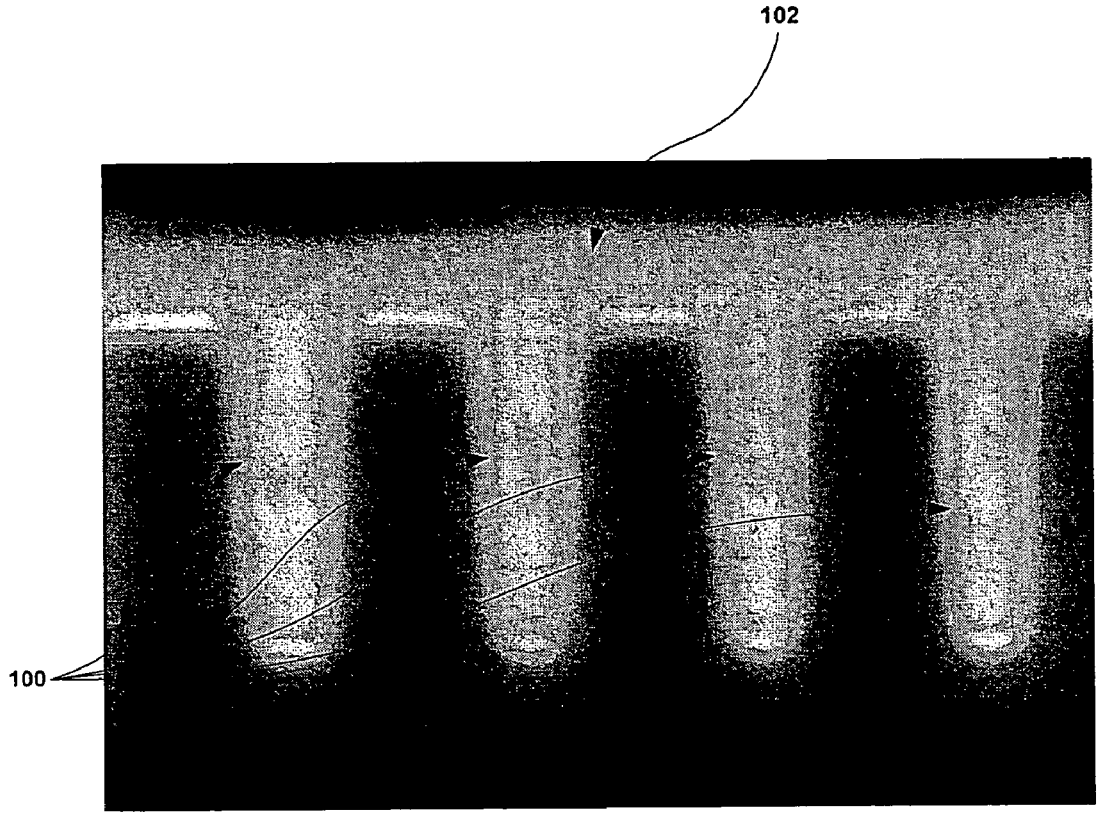
FIG. 1 illustrates a high aspect feature that has been filled using the electroplating bath of the invention.

Described herein are electroless plating baths for performing an electroless copper deposition into high aspect features. In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order not to obscure the illustrative implementations.

Various operations will be described as multiple discrete operations, in turn, in a manner that is most helpful in understanding the present invention, however, the order of description should not be construed to imply that these operations are necessarily order dependent. In particular, these operations need not be performed in the order of presentation.

Electroless plating is a metal deposition process in which the metal begins in solution and a controlled chemical reduction reaction is used to deposit the metal onto a substrate. The electroless process is autocatalytic as the metal being deposited catalyzes the chemical reduction reaction without the need for an external electric current. Electroless plating is a selective deposition and occurs at activated locations on the substrate surface, i.e., locations that have a nucleation potential for an electroless plating bath.

As is known in the art, preparing or treating a surface may be necessary to produce an activated surface. In some implementations, a metal seed layer may be deposited to serve as the activated surface upon which the electroless deposition may occur. This metal seed layer may be deposited using methods such as PVD, CVD, or conventional electroless processes. The activated surface acts as a region that controls the placement of the electrolessly deposited metal since the metal from the electroless plating bath deposits only on the activated surface. The inherent selectivity of the electroless plating process not only results in a substantially void free metal layer, but also results in a higher quality metal layer with improved uniformity and continuity.

The electroless plating bath generally includes water, a water soluble compound containing the metal to be deposited (e.g., a metal salt), a complexing agent (e.g., an organic acid or amine) that prevents chemical reduction of the metal ions in solution while permitting selective chemical reduction on a surface of the target, and a chemical reducing agent for the metal ions (e.g., hypophosphite, dimethylaminoborane (DMAB), formaldehyde, hydrazine, or borohydride). Additionally, the plating bath may include a buffer (e.g., boric acid, an organic add, or an amine) for controlling pH and various optional additives, such as bath stabilizers (e.g., pyridine, thiourea, or molybdates), surfactants (e.g., a glycol), and wetting agents. It is to be understood that the composition of a plating bath will vary depending on the desired plating outcome.

Implementations of the invention provide an electroless copper chemistry for depositing copper metal into narrow features, such as trenches and vias found on a semiconductor substrate, that have high aspect ratios. In some implementations, the aspect ratio for such features may be five or greater. Implementations of the invention also provide a stable plating bath with relatively lower costs and relatively lower health hazards. To deposit copper metal into features having high aspect ratios, implementations of the invention use a novel electroless plating bath. For instance, the electroless deposition process may use an electroless plating bath with a composition that includes, but is not limited to, water, a water-soluble copper-containing compound, a buffering agent, at least two reducing agents, a grain refining additive, a bath stabilizing agent, and a rate controlling additive.

FIG. 1 illustrates high-aspect vias 100 that have been electrolessly filled with copper metal 102 using an electroless plating bath formed in accordance with an implementation of the invention. As shown, the copper-filled via 100 is substantially free of voids.

Figure 2:
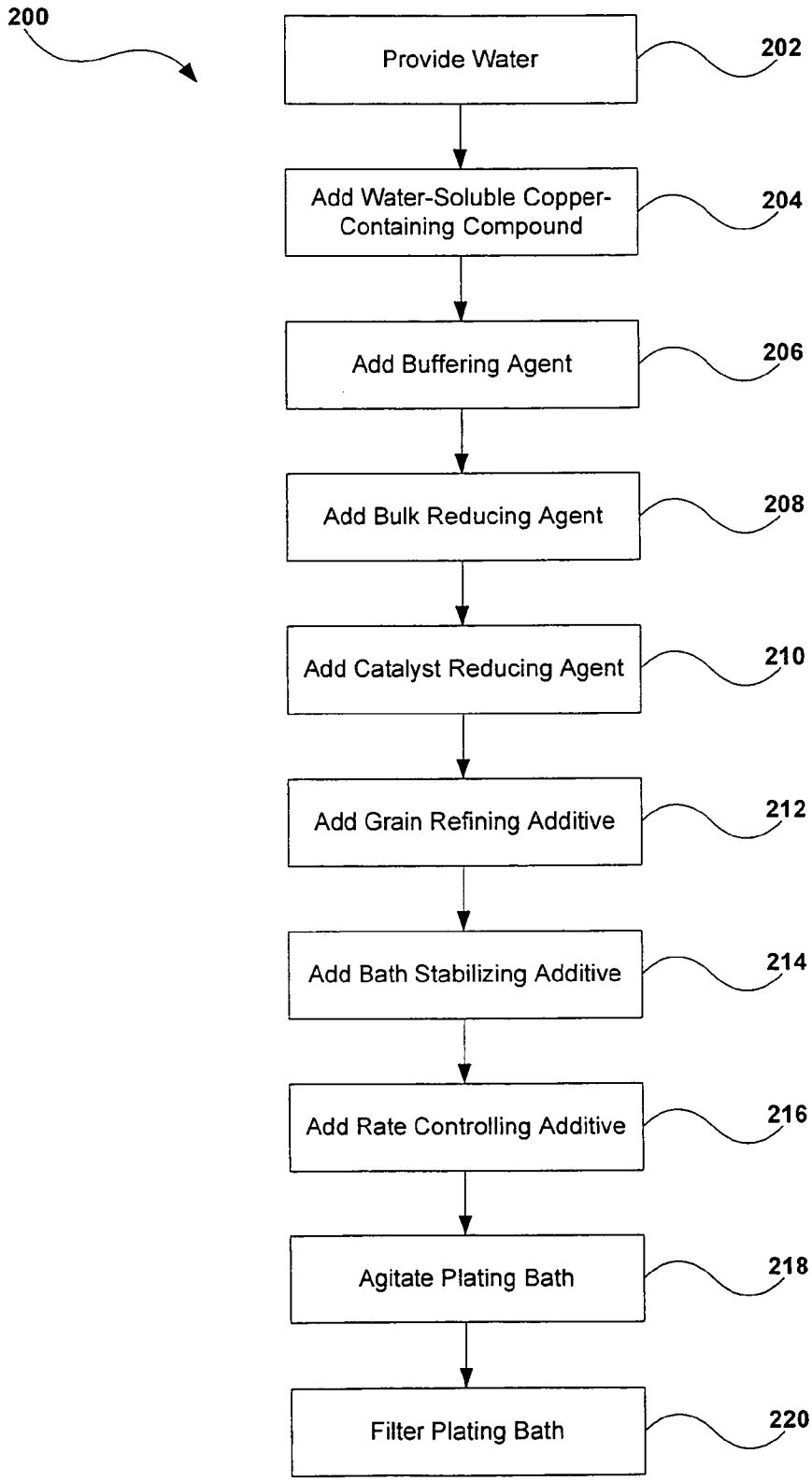
FIG. 2 is a method of forming an electroless plating bath in accordance with implementations of the invention.

FIG. 2 illustrates a method 200 of forming an electroless plating bath in accordance with implementations of the invention. The method 200 begins by providing a quantity of water into which chemicals are added to form the electroless plating bath of the invention (process 202). The quantity of water that is provided will be dependent on how large a plating bath is needed for a particular process.

A water-soluble copper-containing compound may be added to the water (204). The water-soluble copper-containing compound may be may be a copper salt. For example, in some implementations the copper salt may be cupric sulfate (e.g., $CuSO_4$), and in other implementations the copper salt may be copper chloride (e.g., $CuCl_2$). The copper salt provides the copper that will be deposited onto the substrate by the electroless plating process. As will be appreciated by those of skill in the art, alternate copper salts not mentioned here may be used as well. Once added to the water, the copper salt, such as copper sulfate or copper chloride, may have a concentration that is between 0.5 gram/liter (g/L) and 50 g/L in the electroless plating bath of the invention.

A buffering agent may be added to the water (206). In implementations of the invention, the buffering agent may consist of one or more compounds that are well known in the art as buffers for electroless plating baths. For instance, in implementations of the invention, buffering agents that may be used in the bath include, but are not limited to, ethylene diamine tetraacetic acid (EDTA), hydroxyethylene diamine triacetic acid (HEDTA), Rochelle salt (also known as potassium sodium tartarate), an organic acid (e.g., citric acid, tartaric acid, etc.), ammonium citrate, lactate, triethanolamine (TEA), and ethylene diamine. As will be appreciated by those of skill in the art, alternate buffering agents not mentioned here may be used as well. Once added to the water, the buffering agent may have a concentration that is between 25 g/L and 100 g/L in the electroless plating bath of the invention. In general, the concentration of buffering agent will be directly proportional to the concentration of the copper-containing compound.

In accordance with an implementation of the invention, a dual reducing agent formulation may be used in the electroless plating bath. One reducing agent that is added to the water may consist of a bulk reducing agent that is stable and relatively inexpensive (208). The bulk reducing agent makes up the majority of the reducing agent that is added to the electroless plating bath and may or may not be able adequately initiate the reducing chemistry. The other reducing agent that is added to the water may consist of a catalyst reducing agent that is capable of adequately initiating the reducing chemistry (210). A relatively small amount of the catalyst reducing agent is used as the catalyst reducing agent tends to be relatively expensive. Once the reducing chemistry is initiated, the process becomes self-activated. The catalyst reducing agent and the bulk reducing agent may be added simultaneously or separately.

In some implementations, a combination of glycolic acid and glyoxylic acid may be used. Glycolic acid is a stable, less hazardous, and relatively inexpensive reducing agent. The use of glycolic acid in the plating bath may substantially reduce the overall cost of the bath. Glycolic acid may be used as the bulk reducing agent, however, glycolic acid cannot be used as the sole reducing agent because it cannot adequately initiate the reducing chemistry. Therefore, a minimal amount of a catalyst reducing agent, such as glyoxylic acid, is used to initiate the reducing chemistry. Glyoxylic acid is able to adequately initiate the reducing chemistry but glyoxylic acid tends to be an expensive reducing agent. In implementations of the invention, however, this cost is substantially reduced because only a relatively small amount of glyoxylic acid is needed. In some implementations, the glyoxylic acid may be added to the water in a monohydrate form. In alternate implementations, the glyoxylic acid may be added to the water in the form of a solution, for example, as a 50% solution of glyoxylic acid.

In some implementations, the glycolic acid may constitute 95% to 99% of the reducing agent in the plating bath of the invention, while the glyoxylic acid may constitute the remaining 1% to 5% of the reducing agent. In some implementations, the total reducing agent may have a concentration that is between 2.5 g/L and 30 g/L in the electroless plating bath of the invention. Therefore, the glycolic acid content of the reducing agent may range from approximately 2.37 g/L to approximately 29.7 g/L. Similarly, the glyoxylic acid content of the reducing agent may range from approximately 0.02 g/L to approximately 1.5 g/L. As will be recognized by one of ordinary skill in the art, the amount of glyoxylic acid used in the electroless plating bath of the invention is substantially lower than the amount used in conventional plating baths.

In another implementation of the invention, the reducing agent may consist of a combination of a hypophosphite and glyoxylic acid. Similar to the glycolic acid, the hypophosphite is a relatively inexpensive material that can function as the reducing agent but cannot adequately initiate the reducing chemistry. Therefore, a catalyst reducing agent, such as glyoxylic acid, is needed. Examples of hypophosphites that may be used include, but are not limited to, sodium hypophosphite and ammonium hypophosphite. Much like glycolic add, hypophosphites are relatively stable, safe, and relatively inexpensive. Also like glycolic acid, hypophosphites cannot be used as the sole reducing agent, therefore, a minimal amount of glyoxylic add is used in combination with the hypophosphites. In some implementations, the hypophosphite may constitute 95% to 99% of the reducing agent in the plating bath of the invention, while the glyoxylic add may constitute the remaining 1% to 5% of the reducing agent. The total reducing agent may have a concentration that is between 5 g/L and 30 g/L in the electroless plating bath of the invention. Therefore, the hypophosphite content of the reducing agent may range from approximately 2.37 g/L to approximately 29.7 g/L. Similarly, the glyoxylic acid content of the reducing agent may range from approximately 0.02 g/L to approximately 1.5 g/L.

In alternate implementations of the invention, the glyoxylic acid may be replaced with alternate reducing agents that may be used in combination with glycolic add or hypophosphite. Examples of glyoxylic acid replacements in the electroless plating bath of the invention include, but are not limited to, DMAB, hydrazine, borohydride, as well as any other well known metal reducing agent. As will be appreciated by those of skill in the art, alternate reducing agents not mentioned here may be used with the glycolic add or the hypophosphite.

Conventional electroless plating baths generally rely on an expensive reducing agent such as glyoxylic add to function as the sole reducing agent for the entire bath. This drives up the cost of the bath. Unlike conventional baths, the electroless plating bath of the invention uses a dual reducing agent system in which a relatively inexpensive reducing agent makes up the bulk of the reducing agent in the bath, while only a small amount of a relatively expensive reducing agent is used to start or initiate the reducing chemistry.

A grain refining additive may be added to the water (212). In implementations of the invention, the grain refining additive may be a high molecular weight compound that is capable of reducing the grain size of the plated copper metal. By reducing the grain size of the copper, the copper metal may more readily enter high aspect features and reach the bottom of the features while minimizing issues such as obstructing the trench gap or forming a trench overhang. In implementations of the invention, materials that may be used as the grain refining additive include, but are not limited to, polyethylene glycol (PEG), ethylene diamine, propionitrile (also known as ethyl cyanide), and ethylene glycol (EG). Some of these materials may be available in polymeric form, such as PEG which may be available as PEG 2000, PEG 4000, PEG 6000, etc. In accordance with implementations of the invention, the grain refining additive may have a molecular weight that ranges from 1,000 to 10,000. As will be appreciated by those of skill in the art, alternative high molecular weight compounds capable of reducing the grain size of the plated copper metal may be used. Once added to the water, the grain refining additive may have a concentration that is between 0.25 g/L and 5.0 g/L.

A bath stabilizing agent may be added to the water (214). In implementations of the invention, the bath stabilizing agent may consist of one or more compounds that are capable of stabilizing the bath against the formation of undesired cuprous oxide particles for electroless plating processes having relatively long nucleation times. The long nucleation times help to completely fill features with high aspect ratios. In some implementations, the bath stabilizing agent may further function as a leveling agent to produce mirror-like plated surfaces. In implementations of the invention, bath stabilizing agents that may be used include, but are not limited to, thiourea, dypiridil, mercaptobenzothiazole (MBT), benzotriazole, Janus Green B (JGB), cyanide, vanadium pentoxide ($V_2O_5$), as well as certain high molecular weight polymers. Once added to the water, the bath stabilizing agent may have a concentration that is between 0.02 g/L and 0.1 g/L. In alternate implementations, aeration may be used as a stabilizer.

A rate controlling additive may be added to the water (216). In implementations of the invention, the rate controlling additive may consist of one or more compounds that are capable of suppressing the deposition rate of copper metal in certain portions of the substrate while increasing the deposition rate of the copper metal in other portions of the substrate. This may be necessary to fill high aspect ratio features. For example, a bottom-up fill process (also known as superfill) may be used to fill high-aspect features by suppressing the copper deposition rate at the surface of the substrate (often referred to as the "field"), while simultaneously increasing the copper deposition rate within the narrow trenches and vias. Once added to the water, the rate controlling additive may have a concentration that is between 0.01 g/L and 0.5 g/L.

In some implementations, certain rate controlling additives may function to both increase the copper deposition rate within the features while suppressing the copper deposition rate on the field. For instance, certain polymeric additives, such as PEG, may become anchored to the field by techniques that are well known in the art, such as the use of a metal catalyst as an anchoring agent. The anchored polymeric additive substantially prevents copper from depositing on at least portions of the field, thereby suppressing the copper deposition rate at the surface of the substrate. Suppressing metal deposition on the field forces the metal to travel down into the narrow trenches where the metal deposits and fills the gap. The polymeric additive generally does not inhibit metal deposition within the features, such as the narrow trenches and vias, because the size of the high molecular weight polymer substantially prevents it from entering such features. The polymeric additive therefore increases copper deposition within the features by suppressing copper deposition on the top surface.

In some implementations, certain rate controlling additives may be used to suppress the copper deposition rate in areas while other rate controlling additives may be used to increase the copper deposition rate in other areas. For instance, rate controlling additives that may be used to suppress the copper deposition rate on the field include, but are not limited to, polyethers such as polyethylene glycol (PEG), polypropylene glycol (PPG), nitrogen bearing heterocyclic or non-heterocyclic aromatic compounds, large molecular weight polyoxy-alkyl type compounds, and other high molecular weight polymers. Furthermore, rate controlling additives that may be used primarily to increase the copper deposition rate within high-aspect features include, but are not limited to, sulfur-based organic molecules such as bis(sodiumsulfopropyl) disulfide (SPS), other disulfides, and surfactants.

In some implementations, a high molecular weight polymer may be used as a grain refining additive as well as a rate controlling additive. For instance, in some implementations, PEG may be used as both a grain refining additive and a rate controlling additive.

In addition to promoting superfill, the use of rate controlling additives allows the nucleation time to be controlled without having to rely on adjustments to the pH level and/or temperature of the electroless plating bath, as is done in conventional processes. Furthermore, the use of rate controlling additives allows the nucleation time to be varied across the different areas of the substrate (i.e., suppressing the deposition rate on the field while increasing the deposition rate within the features), which cannot be readily accomplished by adjusting the pH level and temperature of the bath. Finally, the use of rate controlling additives enables the electroless plating bath of the invention to be used over a wider pH range and a wider temperature range than conventional processes. For instance, in some implementations, the electroless plating bath described herein may be used within a pH range of pH 10 to pH 12 and a temperature range of 60° C. to 80° C. As will be appreciated by those of skill in the art, alternate rate controlling additives not mentioned here may be used as well.

After the above listed constituents are added, the plating bath may be agitated (218). The agitation time may range from 30 minutes to 90 minutes. The plating bath may also be filtered (220). The filter size used may vary based on a number of factors, but will generally range from 0.01 microns to 1.0 micron.

Different combinations of the above listed constituents that include at least one water-soluble copper-containing compound, at least one buffering agent, at least two reducing agents, at least one grain refining additive, at least one bath stabilizing agent, and at least one rate controlling additive may be used to form electroless plating baths in accordance with implementations of the invention. For instance, in one implementation, the electroless plating bath may include water, 0.5 to 50 g/L of $CuSO_4$, 25 to 100 g/L of EDTA, 0.13 to 1.5 g/L of glyoxylic acid, 2.38 to 28.5 g/L of glycolic acid, 0.25 to 5 g/L of ethylene diamine, 0.02 to 0.1 g/L of MBT, and 0.01 to 0.5 g/L of PEG. And in another implementation, the electroless plating bath may include water, 0.5 to 50 g/L of $CuCl_2$, 25 to 100 g/L of Rochelle salt, 0.13 to 1.5 g/L of glyoxalic acid, 2.38 to 28.5 g/L of hypophosphite, 0.25 to 5 g/L of PEG, 0.02 to 0.1 g/L of thiourea, and 0.01 to 0.5 g/L of SPS. Of course, many further combinations of the above provided constituents is possible.

A substrate containing narrow features to be filled with copper metal may be cleaned prior to being immersed in the electroless plating bath of the invention. In one implementation, such a cleaning process may include applying a mild acidic etchant to the substrate at a temperature between 20° C. and 60° C. and a pH level between pH 3 and pH 5. This cleaning process may remove native oxides or any contaminants from the substrate surface.

Electroless plating baths formed in accordance with implementations of the invention may be used in electroless plating processes to fill high aspect ratio features with copper metal. In some implementations, the surface of the substrate containing the features may include an activated surface to provide a nucleation potential for the electroless plating bath. In some implementations, the activated surface may be a thin conductive layer that may be non-conformal and may be non-continuous. The conductive layer may be deposited using conventional vapor deposition processes such as chemical vapor deposition, atomic layer deposition, or physical vapor deposition. Alternately, the activated surface may be deposited using an electroless process. In other implementations, the electroless plating bath of the invention may be a self-catalytic bath, rendering a conductive layer unnecessary. The surface of the substrate may be only a barrier material without any seed, such as tantalum nitride, tantalum, tungsten, tantalum alloy, as well as other known barrier materials. These substrates may be activated by conventional conductive metal deposition directly on the barrier layer.

In accordance with implementations of the invention, the electroless plating baths described herein may be used under an inert atmosphere when the electroless plating process is carried out. The inert atmosphere may consist of nitrogen, helium, argon, or forming gas. In some implementations, an electroless deposition process using the electroless plating bath of the invention may be carried out under an inert atmosphere with minimal or no delay between process steps. In various implementations, the electroless plating bath of the invention may be applied to the substrate using well known spray techniques, immersion processes, or semi-immersion processes, using tools that may or may not implement point-of-use solution mixing. In implementations, the substrate may be heated prior to the electroless deposition process by using hot chemistry or maintaining a sufficient electroless plating bath temperature.

As is well known in the art, a chemical mechanical polishing process may follow the electroless plating process to remove any excess metal and to planarize the substrate and metal surface, thereby completing formation of a copper interconnect.

Accordingly, electroless plating baths have been disclosed that provide improved copper metal deposition within features, such as trenches and vias, having aspect ratios of 6 or greater. Implementations of the invention described herein provide electroless plating baths that enable electroless plating processes having longer nucleation times while still generating substantially uniform and substantially contamination-free copper layers with low resistivity and low deposition defects. The longer nucleation times generally enable narrower feature fills.

Furthermore, implementations of the invention described herein provide electroless plating baths that may be used over a wider pH range and temperature range relative to conventional electroless plating baths. As described above, the electroless plating baths described herein may be used within a pH range of pH 10 to pH 12 and a temperature range of 60° C. to 80° C.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize.

These modifications may be made to the invention in light of the above detailed description. The terms used in the following claims should not be construed to limit the invention to the specific implementations disclosed in the specification and the claims. Rather, the scope of the invention is to be determined entirely by the following claims, which are to be construed in accordance with established doctrines of claim interpretation.

The invention claimed is:

1. An electroless plating bath optimized for producing a substantially void-free metal fill in an integrated circuit feature having a width of between 5 nm and 20 nm and an aspect ratio greater than 5 comprising:

water;

between 0.5 g/L and 50 g/L of a water-soluble copper-containing compound;

between 0.02 g/L and 1.5 g/L of a catalyst reducing agent comprising glyoxylic acid;

between 2.37 g/L and 29.7 g/L of a bulk reducing agent comprising glycolic acid;

between 25 g/L and 100 g/L of a buffering agent;

between 0.25 g/L and 5.0 g/L of a grain refining additive;

between 0.02 g/L and 0.1 g/L of a bath stabilizing agent; and between 0.01 g/L and 0.5 g/L of a rate controlling additive.

2. The electroless plating bath of claim 1, wherein the water-soluble copper-containing compound comprises at least one compound selected from the group consisting of cupric sulfate and copper chloride.

3. The electroless plating bath of claim 1, wherein the bulk reducing agent further comprises hypophosphite.

4. The electroless plating bath of claim 3, wherein the hypophosphite comprises at least one of sodium hypophosphite or ammonium hypophosphite.

5. The electroless plating bath of claim 1, wherein the buffering agent comprises at least one chemical selected from the group consisting of EDTA, HEDTA, Rochelle salt, an organic acid, citric acid, tartaric acid, ammonium citrate, lactate, TEA, and ethylene diamine.

6. The electroless plating bath of claim 1, wherein the grain refining additive comprises at least one chemical selected from the group consisting of PEG, ethylene diamine, propionitrile, and ethylene glycol.

7. The electroless plating bath of claim 1, wherein the bath stabilizing agent comprises at least one chemical selected from the group consisting of thiourea, dypiridil, MBT, benzotriazole, Janus Green B, cyanide, and $V_2O_5$.

8. The electroless plating bath of claim 1, wherein the rate controlling additive comprises at least one chemical selected from the group consisting of polyethers, PEG, PPG, nitrogen bearing heterocyclic aromatic compounds, nitrogen bearing non-heterocyclic aromatic compounds, large molecular weight polyoxy-alkyl type compounds, high molecular weight polymers, sulfur-based organic molecules, SPS, disulfides, and surfactants.

9. The electroless plating bath of claim 1, wherein the catalyst reducing agent further comprises at least one chemical selected from the group consisting of DMAB, hydrazine, and borohydride.

10. An electroless plating bath optimized for producing a substantially void-free metal fill in an integrated circuit feature having a width of between 5 nm and 20 nm and an aspect ratio greater than 5 comprising:

water;

a water soluble copper containing compound having an initial concentration that is greater than or equal to 0.5 g/L and less than or equal to 50 g/L;

a catalyst reducing agent comprising glyoxylic acid having an initial concentration that is greater than or equal to 0.02 g/L and less than or equal to 1.5 g/L;

a bulk reducing agent comprising hypophosphite having an initial concentration that is greater than or equal to 2.37 g/L and less than or equal to 29.7 g/L;

a buffering agent having an initial concentration that is greater than or equal to 25 g/L and less than or equal to 100 g/L;

a grain refining additive having an initial concentration that is greater than or equal to 0.25 g/L and less than or equal to 5.0 g/L;

a bath stabilizing agent having an initial concentration that is greater than or equal to 0.02 g/L and less than or equal to 0.1 g/L; and a rate controlling additive having an initial concentration that is greater than or equal to 0.01 g/L and less than or equal to 0.5 g/L.

11. The electroless plating bath of claim 10, wherein the water-soluble copper-containing compound comprises at least one compound selected from the group consisting of cupric sulfate and copper chloride.

12. The electroless plating bath of claim 10, wherein the hypophosphite comprises at least one of sodium hypophosphite or ammonium hypophosphite.

13. The electroless plating bath of claim 10, wherein the buffering agent comprises at least one chemical selected from the group consisting of EDTA, HEDTA, Rochelle salt, an organic acid, citric acid, tartaric acid, ammonium citrate, lactate, TEA, and ethylene diamine.

14. The electroless plating bath of claim 10, wherein the grain refining additive comprises at least one chemical selected from the group consisting of PEG, ethylene diamine, propionitrile, and ethylene glycol.

15. The electroless plating bath of claim 10, wherein the bath stabilizing agent comprises at least one chemical selected from the group consisting of thiourea, dypiridil, MBT, benzotriazole, Janus Green B, cyanide, and $V_2O_5$.

16. The electroless plating bath of claim 10, wherein the rate controlling additive comprises at least one chemical selected from the group consisting of polyethers, PEG, PPG, nitrogen bearing heterocyclic aromatic compounds, nitrogen bearing non-heterocyclic aromatic compounds, large molecular weight polyoxy-alkyl type compounds, high molecular weight polymers, sulfur-based organic molecules, SPS, disulfides, and surfactants.

17. The electroless plating bath of claim 10, wherein the catalyst reducing agent further comprises at least one chemical selected from the group consisting of DMAB, hydrazine, and borohydride.

18. A method for making an electroless plating bath that is optimized for producing a substantially void-free metal fill in an integrated circuit feature having a width of between 5 nm and 20 nm and an aspect ratio greater than 5, the method comprising:

providing a quantity of water;

adding a water soluble copper containing compound to the water until its concentration is greater than or equal to 0.5 g/L and less than or equal to 50 g/L;

adding glyoxylic acid to the water until its concentration is greater than or equal to 0.02 g/L and less than or equal to 1.5 g/L;

adding one of glycolic acid or hypophosphite to the water until its concentration is greater than or equal to 2.37 g/L and less than or equal to 29.7 g/L;

adding a buffering agent to the water until its concentration is greater than or equal to 25 g/L and less than or equal to 100 g/L;

adding a grain refining additive to the water until its concentration is greater than or equal to 0.25 g/L and less than or equal to 5.0 g/L;

adding a bath stabilizing agent to the water until its concentration is greater than or equal to 0.02 g/L and less than or equal to 0.1 g/L; and adding a rate controlling additive to the water until its concentration is greater than or equal to 0.01 g/L and less than or equal to 0.5 g/L.

19. The method of claim 18, wherein the water-soluble copper-containing compound comprises at least one compound selected from the group consisting of cupric sulfate and copper chloride.

20. The method of claim 18, wherein the hypophosphite comprises at least one of sodium hypophosphite or ammonium hypophosphite.

21. The method of claim 18, wherein the buffering agent comprises at least one chemical selected from the group consisting of EDTA, HEDTA, Rochelle salt, an organic acid, citric acid, tartaric acid, ammonium citrate, lactate, TEA, and ethylene diamine.

22. The method of claim 18, wherein the grain refining additive comprises at least one chemical selected from the group consisting of PEG, ethylene diamine, propionitrile, and ethylene glycol.

23. The method of claim 18, wherein the bath stabilizing agent comprises at least one chemical selected from the group consisting of thiourea, dypiridil, MBT, benzotriazole, Janus Green B, cyanide, and $V_2O_5$.

24. The method of claim 18, wherein the rate controlling additive comprises at least one chemical selected from the group consisting of polyethers, PEG, PPG, nitrogen bearing heterocyclic aromatic compounds, nitrogen bearing non-heterocyclic aromatic compounds, large molecular weight polyoxy-alkyl type compounds, high molecular weight polymers, sulfur-based organic molecules, SPS, disulfides, and surfactants.

25. The method of claim 18, further comprising:

agitating the electroless plating bath; and filtering the electroless plating bath.

26. The method of claim 25, wherein the electroless plating bath is agitated for a duration of time that is greater than or equal to thirty minutes and is less than or equal to ninety minutes.

27. The method of claim 25, wherein the filtering of the electroless plating bath is performed using a filter with a size that is greater than or equal to 0.01 microns and less than or equal to 1.0 micron.

* * * * *